US010330422B2

(12) United States Patent
Domholt et al.

(10) Patent No.: US 10,330,422 B2
(45) **Date of Patent: *Jun. 25, 2019**

(54) CARTRIDGE BASED MODULAR TURRET CONTROL SYSTEM

(71) Applicant: NPC Robotics Corporation, Mound, MN (US)

(72) Inventors: Norman L. Domholt, Minnetrista, MN (US); Richard Reid, Minnetonka, MN (US); John David, Mound, MN (US); Tyler Andrew Jacobson, Chaska, MN (US); Michael Richmon Thoreson, Mound, MN (US)

(73) Assignee: NPC Robotics Corporation, Mound, MN (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/704,910

(22) Filed: Sep. 14, 2017

(65) Prior Publication Data

US 2018/0017357 A1 Jan. 18, 2018

Related U.S. Application Data

(60) Continuation of application No. 15/055,384, filed on Feb. 26, 2016, which is a continuation-in-part of (Continued)

(51) Int. Cl.
*F41A 27/18* (2006.01)
*F41A 27/20* (2006.01)
(Continued)

(52) U.S. Cl.
CPC ..... *F41A 27/20* (2013.01); *F41A 23/24* (2013.01); *F41A 27/18* (2013.01); *F41G 5/14* (2013.01);
(Continued)

(58) Field of Classification Search
CPC .. F41G 5/14; F41A 23/00; F41A 23/24; F41A 27/10; F41A 27/12; F41A 27/14;
(Continued)

(56) References Cited

U.S. PATENT DOCUMENTS 2,411,114 A * 11/1946 Rice ..... F41A 27/08 89/37.17
3,429,222 A * 2/1969 Flannery ..... F41A 27/20 89/41.01
4,056,250 A * 11/1977 Uchiyama ..... E02F 3/382 248/674
4,338,853 A * 7/1982 Neumeyer ..... F16H 57/12 74/384
(Continued)

*Primary Examiner* — Jonathan Liu
*Assistant Examiner* — Guang H Guan
(74) *Attorney, Agent, or Firm* — Craige Thompson; Thompson Patent Law

(57) ABSTRACT

Apparatus and associated methods relate to a toollessly interchangeable ring gear drive mount system for a rotatable turret including a ring gear, a ring gear drive module, a mount bracket, a pair of receiver members, and a pair of mount flanges. In an exemplary aspect, the mount bracket may extend in a plane perpendicular to an axis of rotation of the ring gear and be adapted for mounting to a platform arranged in a rotatable relationship to the ring gear. The pair of receiver members may extend from the mount bracket and define a pair of slide channels positioned substantially vertically and oriented substantially parallel to the axis of rotation. The pair of mount flanges may each be sized and shaped to be slidably inserted into a corresponding one of the pair of slide channels and adapted to support the ring gear drive module.

13 Claims, 9 Drawing Sheets

Related U.S. Application Data application No. 14/722,819, filed on May 27, 2015, now Pat. No. 9,733,037, which is a continuation of application No. 13/895,787, filed on May 16, 2013, now Pat. No. 9,759,506, which is a division of application No. 12/751,254, filed on Mar. 31, 2010, now Pat. No. 8,443,710.

(60) Provisional application No. 61/165,310, filed on Mar. 31, 2009.

(51) Int. Cl.
*F41A 23/24* (2006.01)
*F41G 5/14* (2006.01)

(52) U.S. Cl.
CPC ..... *Y10T 29/49947* (2015.01); *Y10T 74/19* (2015.01); *Y10T 74/19051* (2015.01)

(58) Field of Classification Search
CPC ..... F41A 27/16; F41A 27/17; F41A 27/20; F41A 27/22; F41A 27/24
USPC ..... 114/5, 6, 7, 8; 89/36.03, 37.03, 37.11, 89/37.12, 37.13, 37.14, 37.16, 37.17, 89/37.21, 40.03, 40.04, 41.01, 41.02; 248/346.01, 346.02, 349.1, 220.21, 248/220.22, 222.14, 223.41, 224.51, 248/224.61, 225.11, 292.12, 425, 522, 248/651, 652, 674
See application file for complete search history.

(56) References Cited

U.S. PATENT DOCUMENTS

| | | | | |
|---|---|---|---|---|
| 4,574,685 | A * | 3/1986 | Sanborn | F41A 23/34 89/36.13 |
| 4,579,036 | A * | 4/1986 | LeBlanc | F41A 27/20 74/625 |
| 6,101,917 | A * | 8/2000 | Klatte | F41A 27/22 89/40.03 |
| 7,030,579 | B1 * | 4/2006 | Schmitz | F41A 23/24 318/139 |
| 7,837,169 | B2 * | 11/2010 | Denis | A01B 33/08 248/316.8 |
| 8,297,171 | B2 * | 10/2012 | Gagnon | F41A 27/20 74/814 |
| 8,443,710 | B2 * | 5/2013 | Domholt | F41A 27/20 89/41.02 |
| 8,584,573 | B2 * | 11/2013 | Prado | F41A 23/34 89/37.01 |
| 8,607,686 | B2 * | 12/2013 | McKee | F41A 27/20 89/41.01 |
| 8,640,597 | B2 * | 2/2014 | Hayden | F41A 27/28 89/37.03 |
| 8,651,009 | B2 * | 2/2014 | Hayden | F41A 27/20 89/41.02 |
| 9,733,037 | B2 * | 8/2017 | Domholt | F41A 27/20 |
| 9,746,270 | B1 * | 8/2017 | Rose | F41A 27/28 |
| 9,759,506 | B2 * | 9/2017 | Domholt | F41A 27/20 |
| 2015/0253110 | A1 * | 9/2015 | Domholt | F41A 27/20 89/41.02 |
| 2018/0017357 | A1 * | 1/2018 | Domholt | F41G 5/02 |

* cited by examiner

CARTRIDGE BASED MODULAR TURRET CONTROL SYSTEM

CROSS-REFERENCE TO RELATED APPLICATIONS

This application claims the benefit and is a continuation of U.S. patent application Ser. No. 15/055,384, entitled "Cartridge Based Modular Turret Control System," filed Feb. 26, 2016 by Domholt, et al., which is a continuation-in-part of U.S. patent application Ser. No. 14/722,819, now issued as U.S. Pat. No. 9,733,037, entitled "Battery-Powered Motor Unit," filed May 27, 2015 by Domholt, et al., which is a continuation of U.S. patent application Ser. No. 13/895,787, now issued as U.S. Pat. No. 9,759,506, entitled "Battery-Powered Motor Unit," filed May 16, 2013 by Domholt, et al., which is a divisional of U.S. patent application Ser. No. 12/751,254, now issued as U.S. Pat. No. 8,443,710, entitled "Battery-Powered Motor Unit," filed Mar. 31, 2010 by Domholt, et al., which claims benefit of U.S. Provisional Application No. 61/165,310, entitled "Battery-Powered Motor Unit," filed Mar. 31, 2009 by Domholt, et al.

This application incorporates the entire contents of the foregoing applications herein by reference.

TECHNICAL FIELD

Various embodiments relate generally to operation of turret systems.

BACKGROUND

Turret gun systems are commonly deployed in military operations. The turret gun systems may be mounted on structures such as buildings, or on vehicles, such as combat vehicles, aircrafts or ships.

Turret gun systems are commonly equipped on armored vehicles and have mountings for large caliber guns. For the turret gun systems to be effective, the rotation of the turret gun system must be accomplished very efficiently. Turret gun systems usually include shields to provide protection to the operator(s) of the turret gun system.

SUMMARY

Apparatus and associated methods relate to a modular cartridge turret assembly system for quickly exchanging modular cartridges to interact with a ring gear. A modular cartridge may be a brake cartridge, which when inserted into a modular cartridge turret assembly, operably engages with the ring gear to inhibit the rotation of a turret. In an illustrative example, the brake cartridge, when inserted, may prevent damages and injuries caused by the rotation of the turret during transportation. In an exemplary embodiment, the modular cartridge turret assembly system may include a locking mechanism to secure the modular cartridge within the modular cartridge turret assembly. The locking mechanism may safeguard that the brake cartridge remains within the modular cartridge turret assembly system during turbulent situations caused by environmental conditions.

Various embodiments may achieve one or more advantages. For example, some embodiments may include a hand crank cartridge to actuate rotation of the turret when the hand crank cartridge is installed. In an illustrative example, the brake cartridge may be removed from the modular cartridge turret assembly by releasing the locking mechanism. The hand crank cartridge may be inserted into the modular cartridge turret assembly immediately after the removal of the brake cartridge without the need of any tools. In another embodiment, the hand crank cartridge may include a brake mechanism to operably engage with the ring gear to inhibit the rotation of a turret. In another embodiment, the modular cartridge may be an electrically powered motor cartridge.

The modular cartridge turret assembly system for quickly exchanging modular cartridges may provide cost-savings. For example, if the hand crank cartridge malfunctioned or was damaged, only the hand crank cartridge would need to be replaced. The modular cartridge turret assembly system may include individual slide flanges to couple to pre-existing motors or hand cranks. Once the slide flanges are coupled to the motor, for example, the motor may be used with the modular cartridge turret assembly system. The slide flanges may be of different sizes and shapes to accommodate various types of motors, hand cranks, and combination systems.

In some embodiments, the locking mechanism may be an install pin. For example, the modular cartridge turret assembly and the modular cartridge may include apertures into which an install pin may be inserted. In other embodiments, the locking mechanism may be a self-biased locking mechanism that releasably attaches to either the modular cartridge turret assembly or the modular cartridge.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1A:
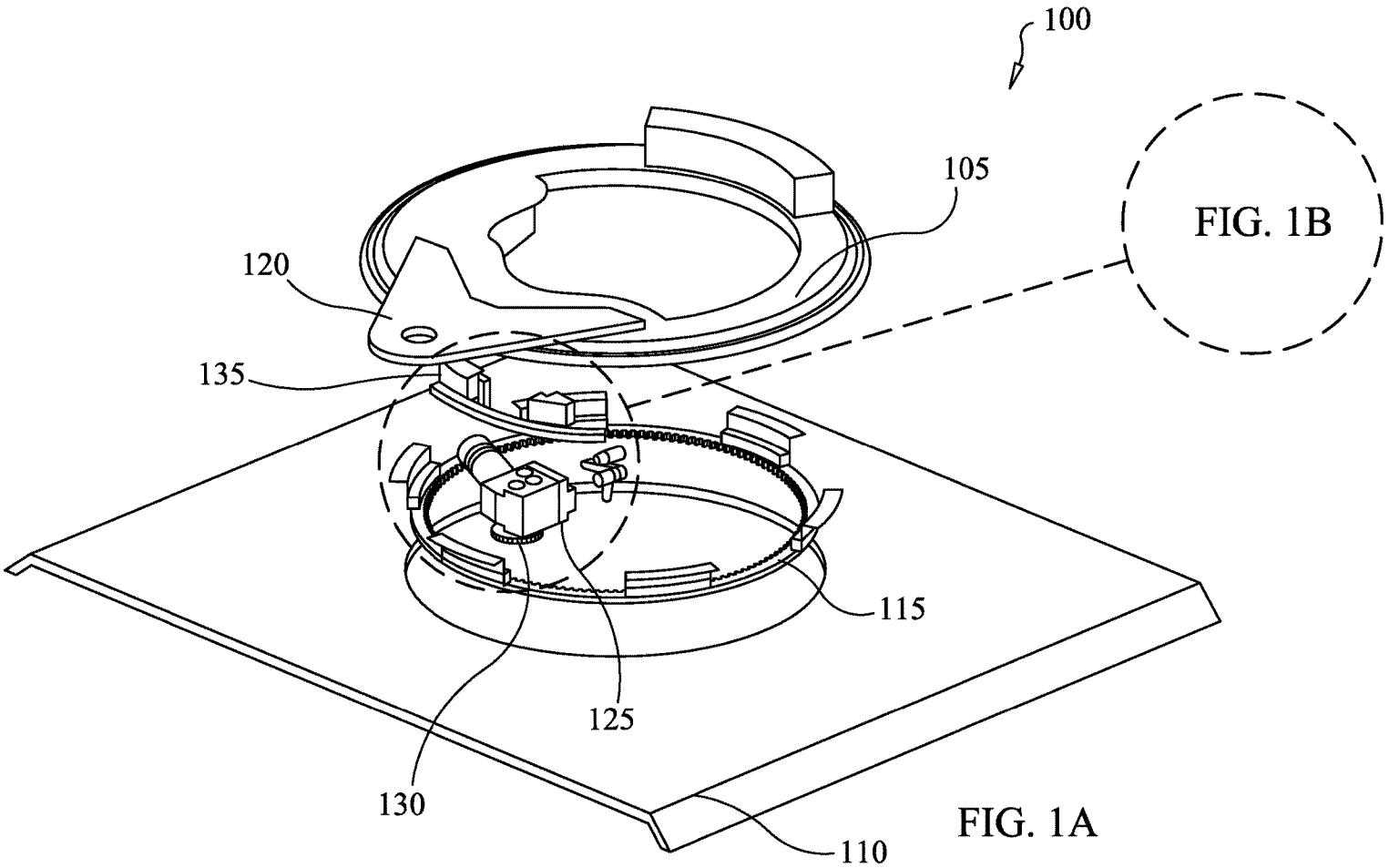
FIGS. 1A-1B depict an exploded view of a turret system including an exemplary cartridge mounting assembly and a magnified view of a cartridge mounting assembly.
Figure 1B:
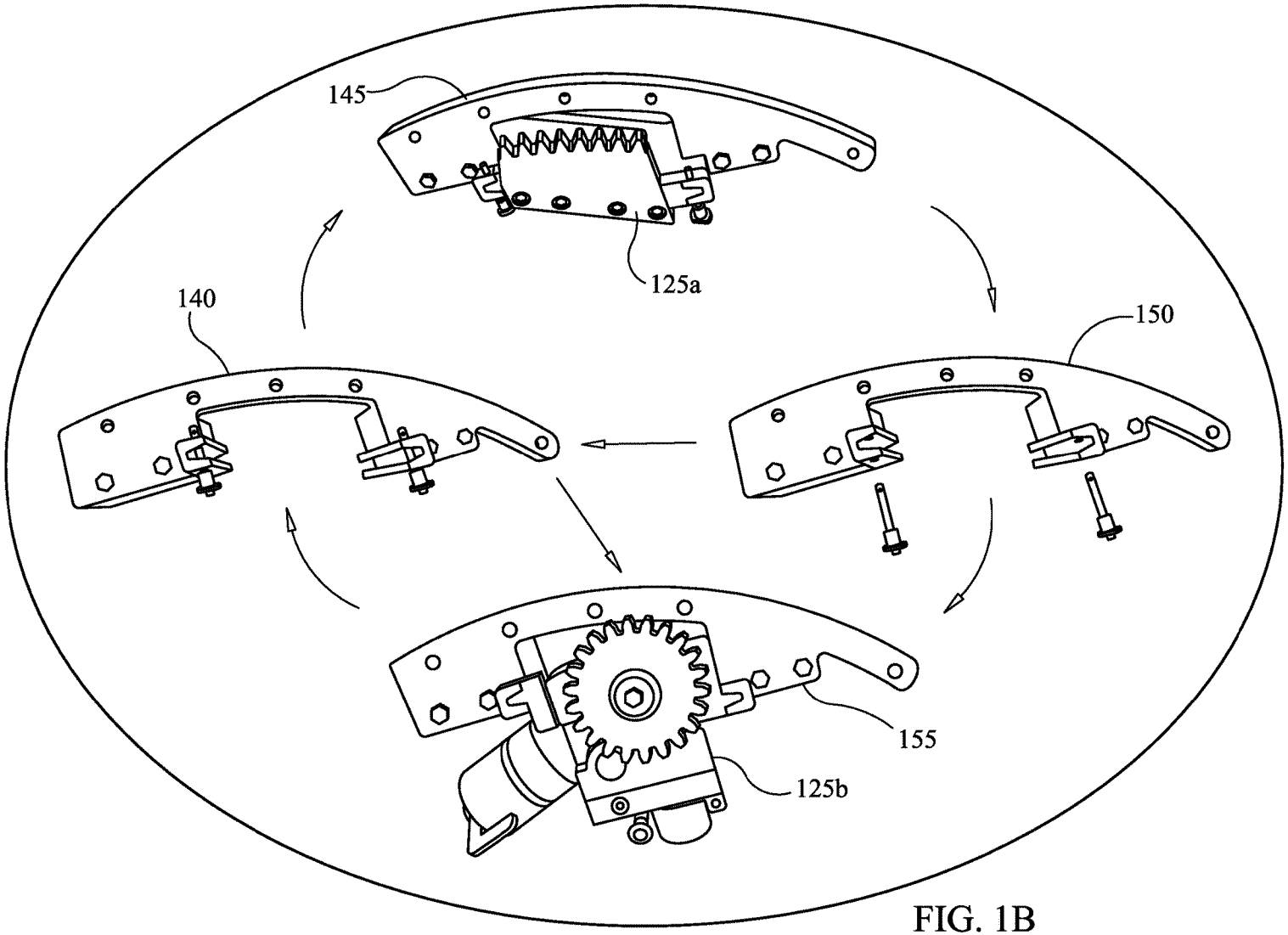

FIGS. 1A-1B depict an exploded view of a turret system including an exemplary cartridge mounting assembly and a magnified view of the cartridge mounting assembly. As depicted in FIG. 1A, a turret system 100 includes a cover plate 105 and a base plate 110. The cover plate 105 shields a ring gear 115 that is attached to the base plate. The cover plate 105, as depicted, includes an extended portion 120 where a cartridge ring gear engagement module (CRGEM) 125 communicates with the ring gear 115. The CRGEM 125 includes a gear engagement component 130, such that, when the CRGEM 125 installs on a cartridge mounting assembly (CMA) 135, the CRGEM 125 mounts to an inner race of a bearing (not shown) where the gear engagement component 130 is in operable communication with the ring gear 115 to actuate rotation of the turret system 100. A pair of slide flange securing mechanisms, such as, for example, install pins (not shown) may secure the CRGEM 125 when installed on the CMA 130.

As depicted, FIG. 1B magnifies the CMA 135 to illustrated various CRGEM 125 components that may be quickly installed and uninstalled in a variety of different steps. Beginning at 140, the CMA 130 does not have any CRGEMs 125*a*, 125*b* installed. A CRGEM 125*a* is installed on the CMA 135, at 145. The CRGEM 125*a* is a rotation prevention module that inhibits the turret system 100 from rotating. A rotation prevention module may be advantageous, for example, when transporting the turret system 100 via ship or airplane.

At 150, the CRGEM 125*a* is uninstalled. The CMA 135 may remain empty as in 140, or another CRGEM 125*b* may be installed. At 155, CRGEM 125*b* is installed on the CMA 135. The CRGEM 125*b* may include a mechanical hand crank to be used to actuate rotation of the turret system. The CRGEM 125*b* may be installed during deployment of the turret system 100 to actuate rotation of the turret system 100 when out in the field.

In some embodiments, the CRGEM 125*b* may be a battery powered motor of various sizes, including, for example, a standard size battery powered motor or a heavy-duty size battery powered motor. The CMA 135 may permit exchange of various CRGEMs 125 in a quick manner to effectively change the operation modes of the turret system, for example, from a transportation mode to a deployment mode.

Figure 2:
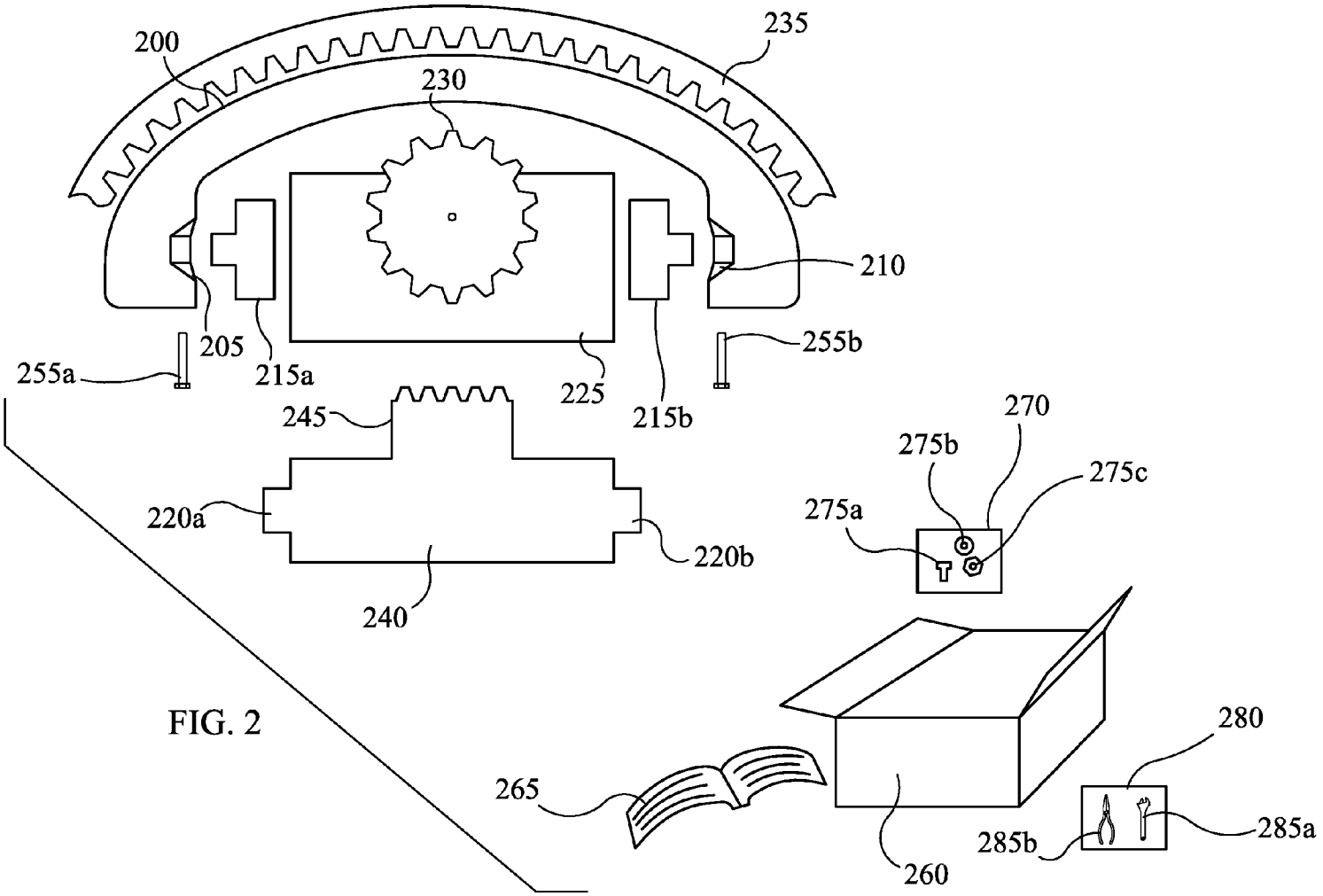
FIG. 2 depicts a top view of an exemplary cartridge mounting assembly, a set of cartridge ring gear engagement modules, and a pair of cartridge flanges.

FIG. 2 depicts a top view of an exemplary cartridge mounting assembly, a set of cartridge ring gear engagement modules, and a pair of cartridge flanges. The CMA 200, as depicted, includes a pair of mounting surfaces (not shown) for mounting the CMA 200 to a structure. In some embodiments, the mounting surfaces may have a curvature consistent with a structure to which the CMA 200 will be mounted. For example, a curvature of the mounting surfaces may be consistent with the turret system 100, or a vehicle.

As depicted, a pair of slide channels 205, 210 form on opposite sides of the CMA 200. The slide channels 205, 210 are configured to receive slide flanges 215*a*-215*b*, 220*a*-220*b*. The slide flanges 215*a*, 215*b* are configured to attach to a CRGEM 225. The slide flanges 215*a*, 215*b* may slideably engage the slide channels 205, 210. When the CRGEM 225 is attached to the slide flanges 215*a*, 215*b* and the slide flanges 215*a*, 215*b* are received by the slide channels 205, 210, a ring gear engagement component 230 of the CRGEM 225 is in operable communication with a ring gear 235. In some embodiments, the CRGEM 225 may be an electric motor including a hand crank and a brake. In other embodiments, the CRGEM 225 may be a hand crank with no electrical components.

As depicted, the slide flanges 220*a*, 220*b* form part of the construction of a CRGEM 240. The slide flanges 220*a*, 220*b* may slideably engage the slide channels 205, 210. When the slide flanges 220*a*, 220*b* are received by the slide channels 205, 210, a ring gear engagement component 245 of the CRGEM 240 is in operable communication with the ring gear 235. As depicted, the ring gear engagement component 245 is a rigid unitary piece to inhibit the ring gear 235 from rotating. The CRGEM 240 may be constructed of a rigid material, for example, cast iron.

The slide flanges 215*a*-215*b*, 220*a*-220*b* may include apertures that align to apertures included in the slide channels 205, 210. When the apertures of the slide flanges 215*a*-215*b*, 220*a*-220*b* and of the slide channels 205, 210 align, a pair of install pins 255*a*, 255*b* may be inserted through the aligned apertures to secure the CRGEM 225, 240 to the CMA 200.

The CMA 200, the slide flanges 215*a*, 215*b*, and the CRGEMs 225, 240 may be contained as a kit in a container 260. As depicted, the container 260 is a box. In other embodiments, the container 260 may be cylindrical or rectangular, or a pallet, for example. The container 260 may be constructed of any material suitable to hold the CMA 200, the slide flanges 215*a*, 215*b*, and the CRGEMs 225, 240. For example, the container 260 may be constructed from wood, plastic, or cardboard. In some embodiments, the container 260 may include compartments to arrange the CMA 200, the slide flanges 215*a*, 215*b*, and the CRGEMs 225, 240 within the container 260.

The container 260 may also include assembly packaging 270 to hold fasteners that may be used to attach the CMA 200 to a structure. For examples, the fasteners may be bolts 275*a*, washers 275*b*, and nuts 275*c*. In other embodiments, the assembly packaging may include bolts 275*a*, washers 275*b*, and nuts 275*c* of various sizes and lengths for attaching the CMA 200 to a variety of structures. In some embodiments, the assembly packaging 270 may include other parts aside from fasteners. For example, the assembly packaging 270 may include spacers or standoffs.

The container 260 may further include a tools packaging 280. As depicted, the tools packaging 280 includes an open-end wrench 285*a* and an adjustable plier wrench 285*b*. The tools packaging 280 may include other tools necessary to attach the CMA 200 to a structure. For example, screwdrivers, ratchet wrenches, or torque wrenches may be included in the tools packaging 260. In an exemplary embodiment, the tools included in the tools packaging 280 complements the components of the assembly packaging 270. An instruction manual 265 is included in the container 260. The instruction manual 265 may include instructions for attaching the CMA 200 to different structures. In some embodiments, other manuals and information may be included in the container 260, such as, for example, maintenance guidelines or warranty information for the CMA 200, the slide flanges 215*a*, 215*b*, and the CRGEMs 225, 240.

Figure 3:
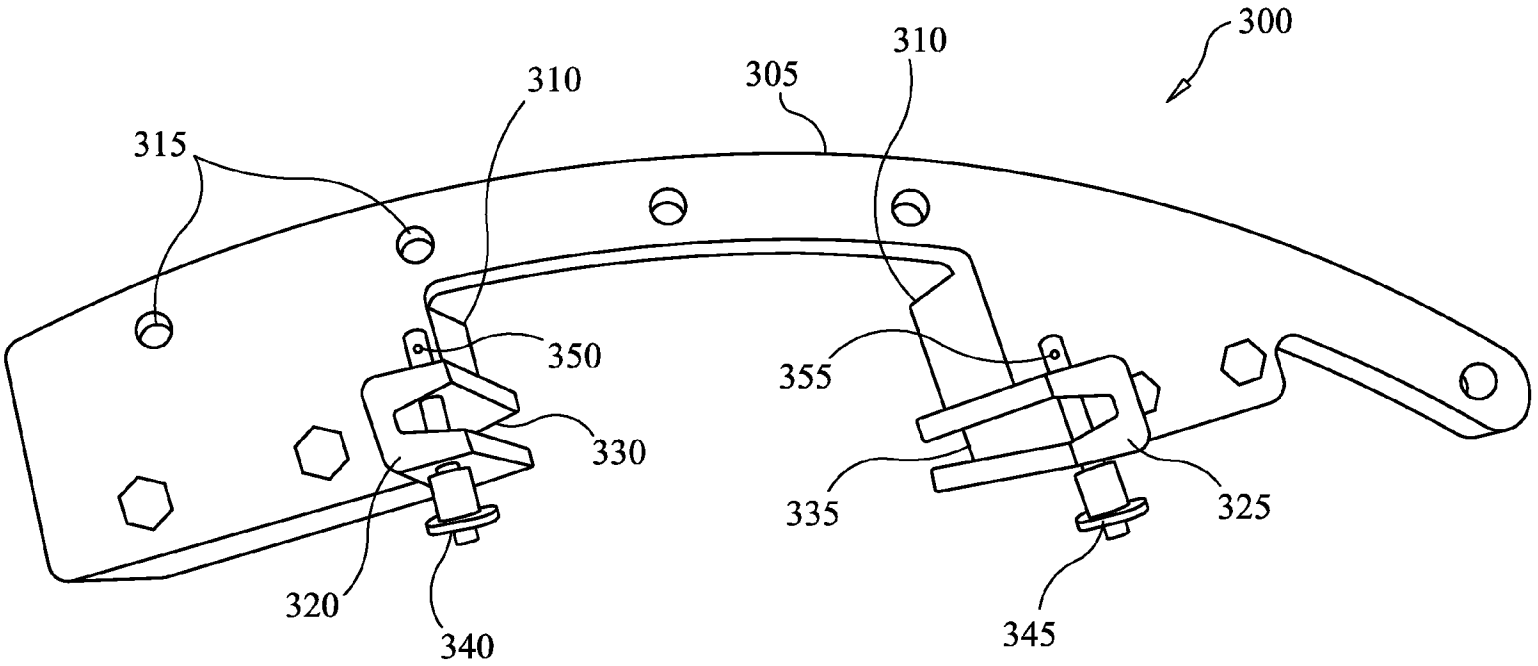
FIG. 3 depicts a top view of an exemplary cartridge mounting assembly.

FIG. 3 depicts a top view of an exemplary cartridge mounting assembly. A CMA 300 includes a structure mounting flange 305 and a pair of mounting surfaces 310. The structure mounting flange 305 has a curvature consistent with a structure, for example, a turret, on which the CMA 30 may be mounted. As depicted, the structure mounting flange 305 and the pair of mounting surfaces 310 are substantially perpendicular relative to one another. The mounting surfaces 310 are configured to complement the mounting flange 305 when mounting to a structure. The structure mounting flange 305 includes mounting apertures 315 to secure the CMA 300 to the structure. The mounting surfaces may also include mounting apertures to secure the CMA 300 to the structure. In some embodiments, the structure mounting flange 305 and mounting surfaces 310 may be a unitary rigid material, such as, for example steel.

As depicted, a first receiving surface 320 and a second receiving surface 325 are formed by the CMA 300. The receiving surfaces 320, 325 have a U-shaped construction forming slide channels 330, 335. The U-shaped construction includes a base wall that is coupled to the structure mounting flange 305. The U-shaped construction further includes two opposing side walls extending from the base wall. The slide channels 330,335 are configured to receive slide flanges (described in further detail in FIGS. 4 and 6) to engage operable communication between a CRGEM (reference numbers 400 or 600 in FIGS. 4 and 6, respectively) and the CMA 300. In some embodiments, the thickness of the base wall at one end of the slide channel 330 is less than the thickness of the base wall at an opposite end of the slide channel 330.

The receiving surfaces 320, 325 include install pin apertures (not shown) that align on each of the U-shaped walls. In some embodiments, only one of the receiving walls 320, 325 may have install pin apertures. Install pins 340, 345 are inserted in the aligned apertures of the receiving surfaces 320, 325. The install pins 340, 345 include a pin securing mechanism 350, 355 to prevent the install pins 340, 345 from sliding out of the install pin apertures after being inserted. As depicted, the pin securing mechanism 350, 355 is a spring-loaded mechanism that requires a minimum specific load for the install pins 320, 325 to be removed. In some embodiments, the pin securing mechanism 350, 355 may be other securing mechanisms, such as, for example, lynch pins, R-clips, split pins, or retaining pins.

Figure 4:
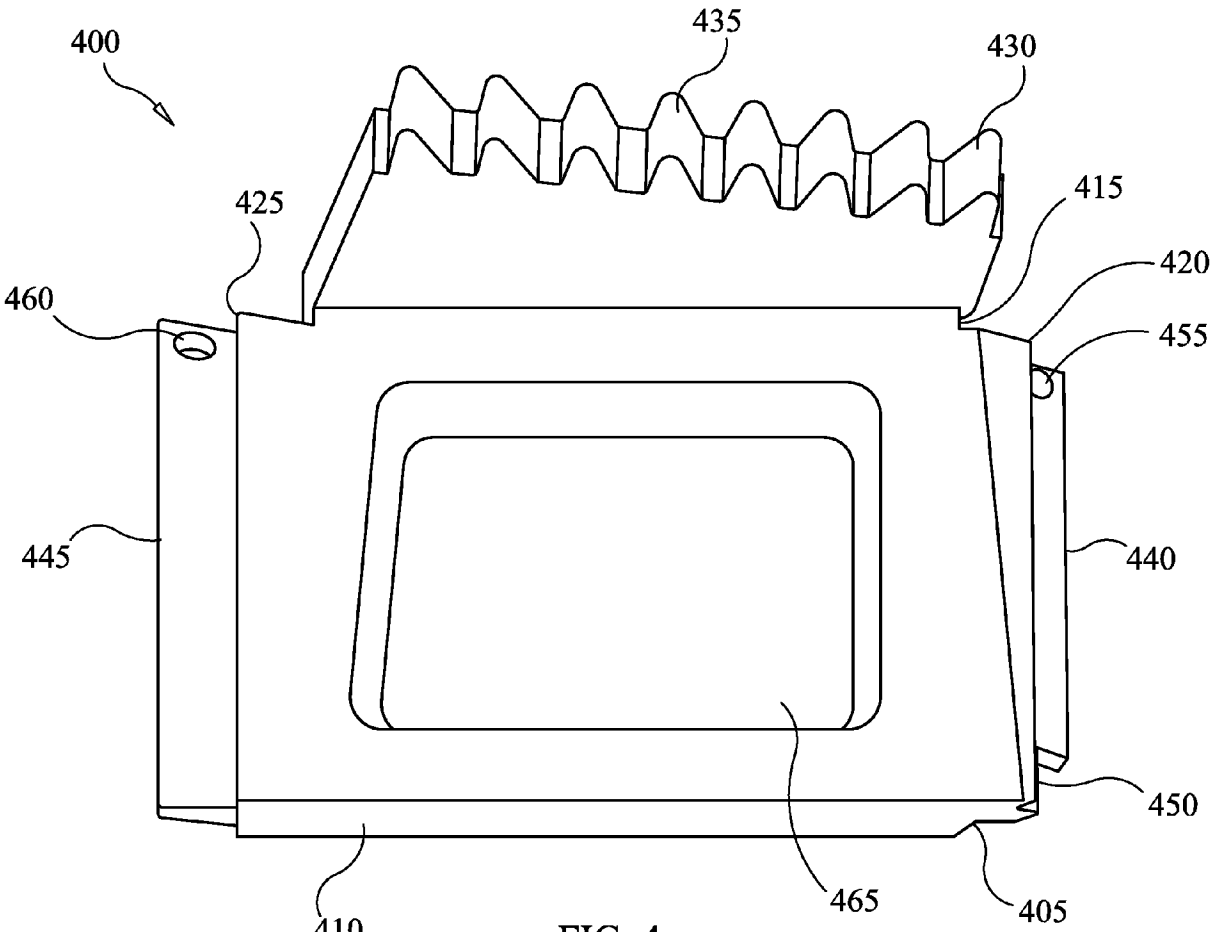
FIG. 4 depicts a perspective view of an exemplary cartridge ring gear engagement module for inhibiting rotation of a turret.

FIG. 4 depicts a perspective view of an exemplary cartridge ring gear engagement module for inhibiting rotation of a turret. As depicted, the CRGEM 400 includes a brake base 405. The brake base 405 includes a bottom end 410 and a top end 415, the bottom end 405 and the top end 415 being substantially parallel to each other. The bottom end 410 and top end 415 are connected by side ends 420, 425 defining a substantially rectangular shape for the brake base 405. A gear communication module 430 extends from the top end 415 substantially orthogonal to the side ends 420, 425. The gear communication module 430 includes a set of teeth 435 to operabably engage the ring gear 115. As depicted, the set of teeth 435 are of a triangular shape. In some embodiments, the set of teeth 435 may be other shapes, for example, rectangular or square.

A pair of slide flanges 440, 445 extend from the side walls 420, 425. The slide flange 440 does not extend equally from the side wall 420 between the top end 415 and the bottom end 410. The slide flange 440 may be formed to compliment a receiving surface 325 by defining a surface distance that increases along the line of travel of a gravity vector. The gravity vector being parallel to the slide flanges 440, 445 when the CRGEM 400 is installed in the CMA 300, which is mounted to a structure. As depicted, the slide flange 440 ends before reaching the bottom end 410 to form a slide support surface 450. The slide support surface 450 may interface with a respective support surface of a slide channel to contain the slide flange 440 within the slide channel when engaged. Near the top end 415, the slide flange 440 includes a slide flange aperture 455. The slide flange aperture 455 may align with the install pin apertures of the receiving surface 325 of the slide channel 335, and when aligned, the install pin 345 may be inserted through the respective apertures to secure the brake base 405 within the CMA 300.

The slide flange 445 extends substantially equally from the side wall 425 between the top end 415 and the bottom end 410. The slide flange 445 may be formed to compliment a receiving surface 330. The slide flange 445 includes a slide flange aperture 460 near the top end 415. The slide flange aperture 460 may align with the install pin apertures of the receiving surface 320 of the slide channel 330, and when aligned, the install pin 340 may be inserted through the respective apertures to secure the brake base 405 within the CMA 300.

As depicted, the brake base 405 includes a brake base aperture 465 at the approximate center of the brake base 405. In some embodiments, the size of the brake base aperture 465 may be smaller or bigger to manage the weight or grip-ability of the CRGEM 400. In other embodiments, the brake base may not include a brake base aperture 465 to maximize the weight of the CRGEM 400.

In some embodiments, the CRGEM 400 may be installed to facilitate transportation of the turret system 100. For example, the CRGEM 400 may be installed to prevent the turret from rotating while being transported by a ship or an airplane.

Figure 5:
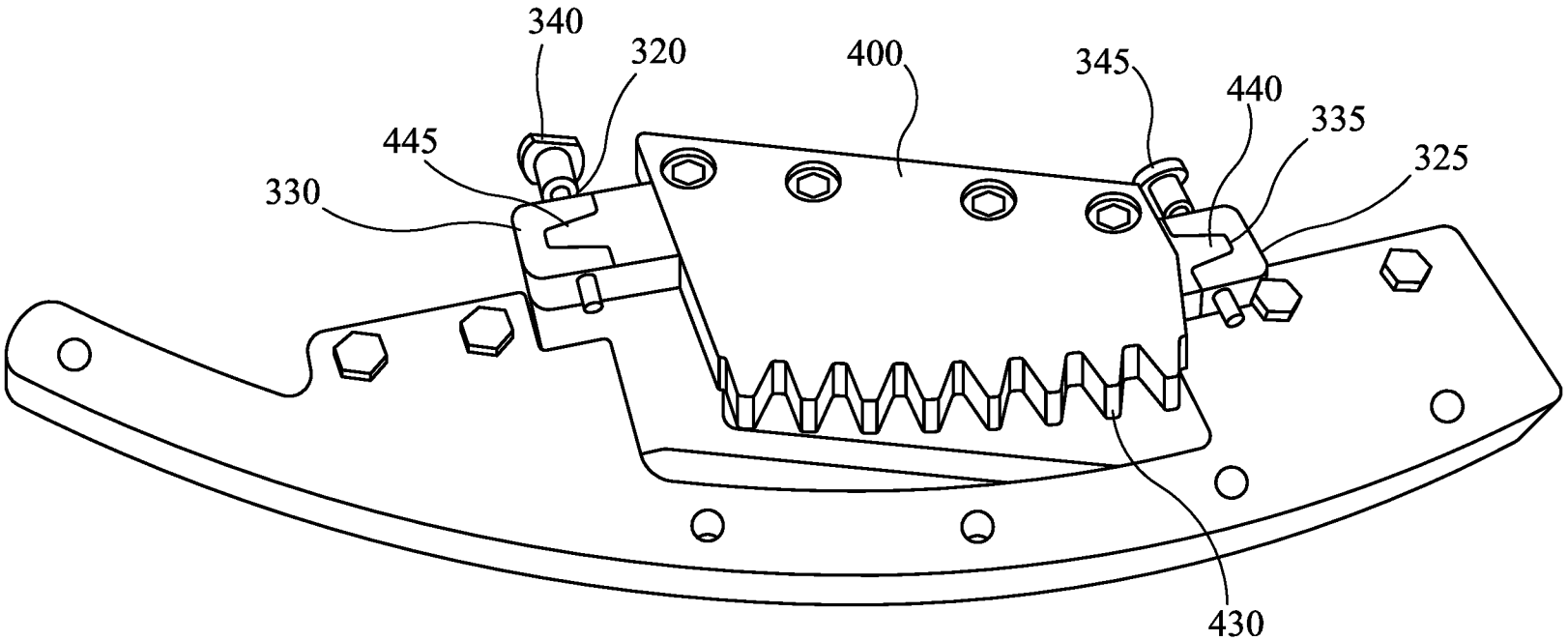
FIG. 5 depicts a top view of an exemplary cartridge ring gear engagement module coupled to a cartridge mounting assembly for inhibiting rotation of a turret.

FIG. 5 depicts a top view of an exemplary cartridge ring gear engagement module coupled to a cartridge mounting assembly for inhibiting rotation of a turret. As depicted, the CMA 300 is coupled to the CRGEM 400. The slide flange 440 is slidably received by the slide channel 335. The install pin 345 is inserted through the install pin apertures of the receiving surface 325. The slide flange 445 is slidably received by the slide channel 330. The install pin 340 is inserted through the install pin apertures of the receiving surface 320. As depicted, with the install pins inserted, the CRGEM 400 is securely coupled to the CMA 300. In the turret system 100, the gear communication module 430 is in a plane parallel with the ring gear 115 when the brake base 405 is installed in the CMA 300.

The CRGEM 400 may be quickly removed from the CMA 300 by removing the install pins 340, 345 and slidably disengaging the slide flanges 440, 445 from the slide channels 330, 335.

Figure 6:
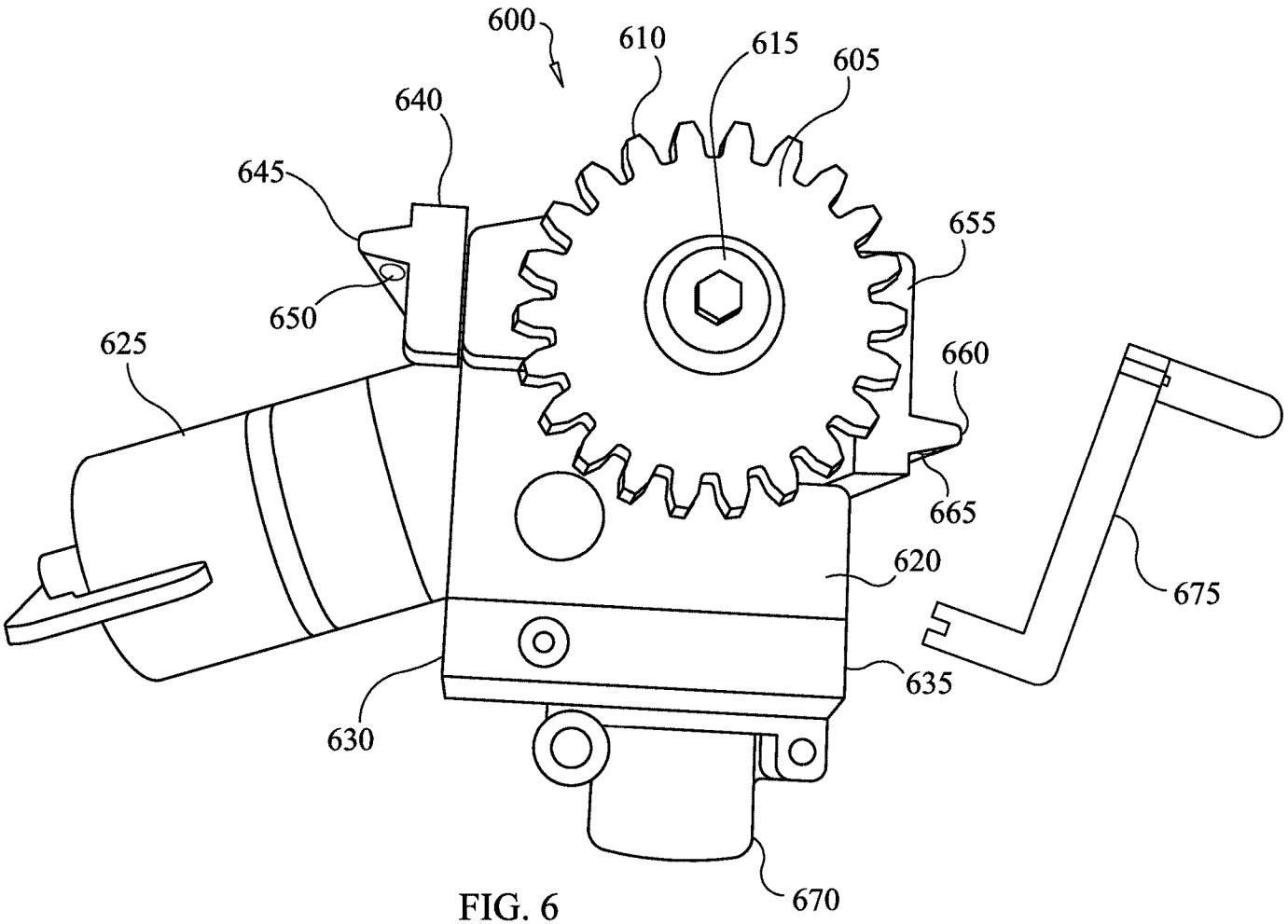
FIG. 6 depicts a top view of an exemplary cartridge ring gear engagement module for actuating rotation of a turret.

FIG. 6 depicts a top view of an exemplary cartridge ring gear engagement module for actuating rotation of a turret. The CRGEM 600 includes a ring engagement module 605 with a ring of teeth 610 around a circumference about the drive gear 615. The drive gear 615 attaches the ring of teeth 610 to a housing body 620 of the CRGEM 600. A housing portion 625 extends from the housing side 630. As depicted, the housing portion 625 is cylindrical in shape. The housing portion 625 may contain a drive gear mechanism to drive the drive gear 615 to actuate the ring engagement module 605. In some embodiments, the housing portion 625 may be of another shape, for example, rectangular. The drive gear mechanism may be a hand crank brake. In other embodiments, the drive gear mechanism may be motorized, for example, an electromagnetic motor.

A pair of slide flange mounts 640, 655 attach to housing sides 630, 635 of the housing body 620. In the depicted embodiment, the slide flange mount 640 is configured to attach to the housing side 630 adjacent to the housing portion 625. The slide flange mount 640 forms a slide flange 645 to be received by the slide channel 335. The slide flange 645 includes a slide flange aperture 650. The slide flange mount 655 is configured to attach to the housing side 635. The slide flange mount 655 forms a slide flange 660 to be received by the slide channel 330. The slide flange 660 includes a slide flange aperture 665. As depicted, the slide flange mount 655 is larger than the slide flange mount 640. In some embodiments, the slide flange mounts 640, 655 may be approximately equal in size. In other embodiments, the slide flange 640 may be larger than slide flange 655.

The housing body 620 includes a manual input shaft (not shown). The manual input is in operable communication with the drive mechanism to drive the driver gear 615. A drive cap 670 is pivotably disposed over the manual input shaft. The drive cap 670, when opened, may receive a handle 675. The handle 675, when attached to the manual input shaft, may be operated to drive gear mechanism to drive the drive gear 615 to actuate the ring engagement module 605. The handle 675 has a coupling end that is configured to removably attach to the manual input shaft. As depicted, the coupling end has U-shaped coupling to interface with the manual input shaft. In some embodiments, the handle 670 may have other coupling ends, as such, for example, the handle 670 and the manual input shaft may mutually define a pin passage to receive a handle pin to secure the handle 670 to the manual input.

Figure 7:
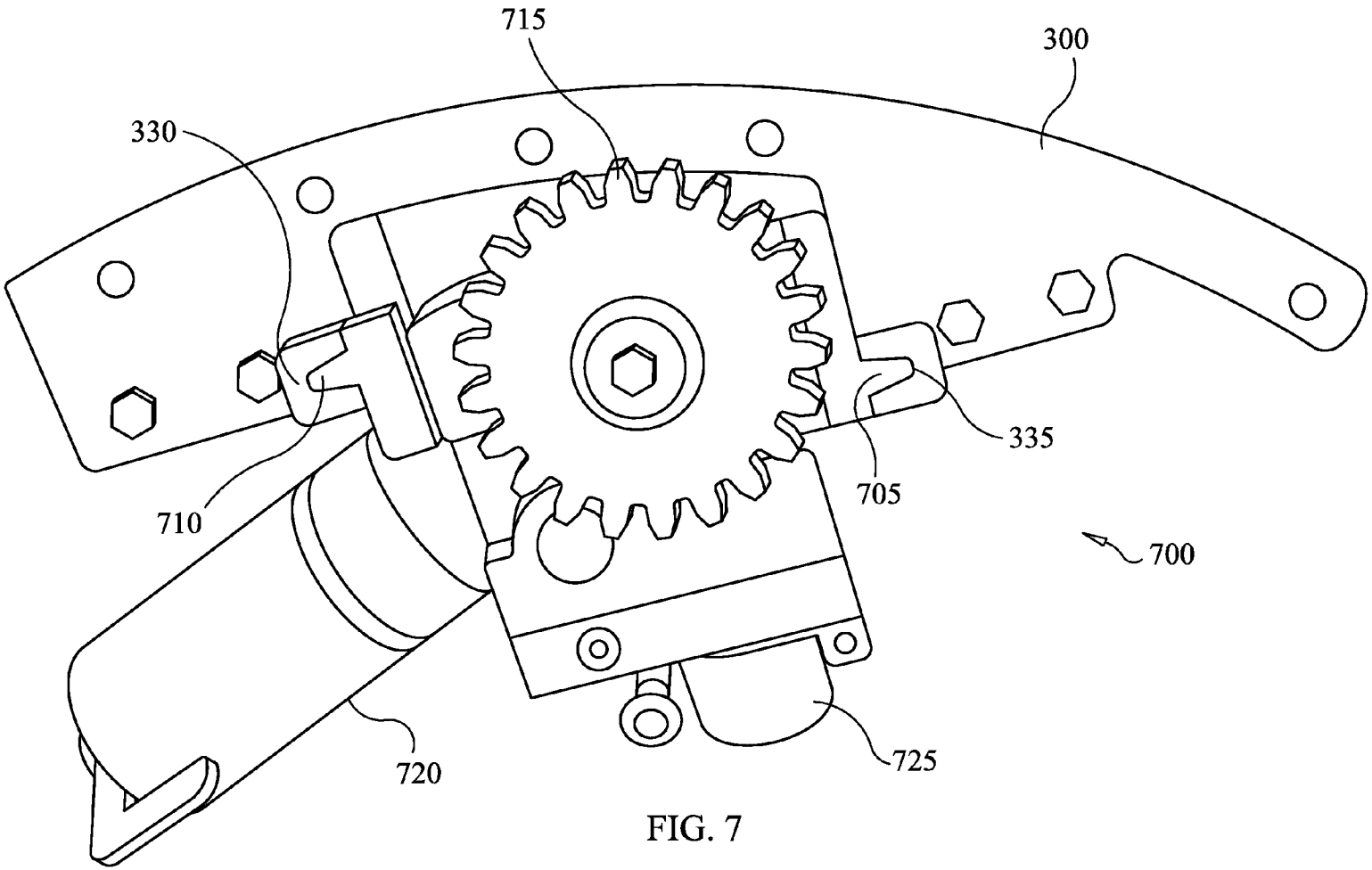
FIG. 7 depicts a top view of an exemplary cartridge ring gear engagement module coupled to a cartridge mounting assembly for actuating rotation of a turret.

FIG. 7 depicts a top view of an exemplary cartridge ring gear engagement module coupled to a cartridge mounting assembly for actuating rotation of a turret. As depicted, the CMA 300 is coupled to the CRGEM 700. The slide flange 705 is slidably received by the slide channel 335. The slide flange 710 is slidably received by the slide channel 330. When the CMA 300 is installed on a structure with a ring gear, the ring of teeth 715 are positioned to interface with a ring gear. As depicted, the housing portion 720 is longer than the housing portion 625 of the CRGEM 600. The housing portion 720 may be configured to hold an electrical motor to drive a driver gear. A drive cap 725 is pivotably disposed over the manual input shaft. The drive cap 725, when opened, may receive a handle to drive a drive gear to actuate a ring engagement module 715. The drive cap 726 may include an override switch configured to prevent operation of the electrical motor when the drive cap 726 is open.

Figure 8A:
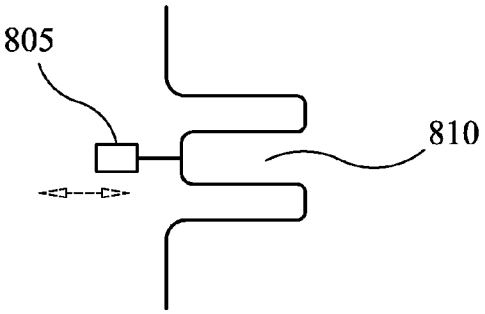
FIGS. 8A, 8B, and 8C depict top views of various exemplary slide flange locking mechanisms.
Figure 8B:
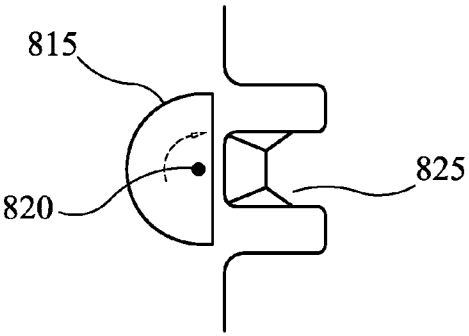
Figure 8C:
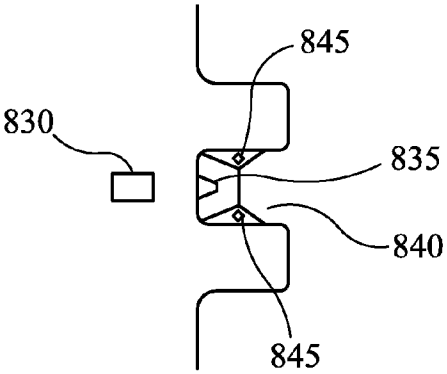

FIGS. 8A-8C depict top views of various exemplary slide flange locking mechanisms. FIG. 8A depicts a slide flange securing mechanisms having a slide lock 805. The slide lock 805 may slide to cover a slide flange received by a slide channel 810 to secure the slide flange within the slide channel 810. As depicted, the inner walls of the slide channel 810 are substantially parallel to each other. FIG. 8B depicts a slide flange securing mechanisms having a rotary lock 815. The rotary lock 815 rotates about a rotation attachment pin 820 to cover a slide flange received by a slide channel 825 to secure the slide flange within the slide channel 825. FIG. 8C depicts a slide flange securing mechanism having a button release 830. As depicted, a self-biased locking mechanism 835 is located within the slide channel 840. A slide flange (not shown) is configured to define an engagement area to receive the self-biased locking mechanism 835. After the engagement area releasably engages the spring loaded component 835, the button release 830 must be pressed to remove the slide flange from the slide channel 840. As depicted, the slide channel 840 includes a pair of apertures 845 configured to releasably engage a slide flange self-biased locking mechanism (not shown) to secure the slide flange within the slide channel 840. The slide flange self-biased locking mechanism may be released by pressing a release button located on the slide flange.

Figure 8D:
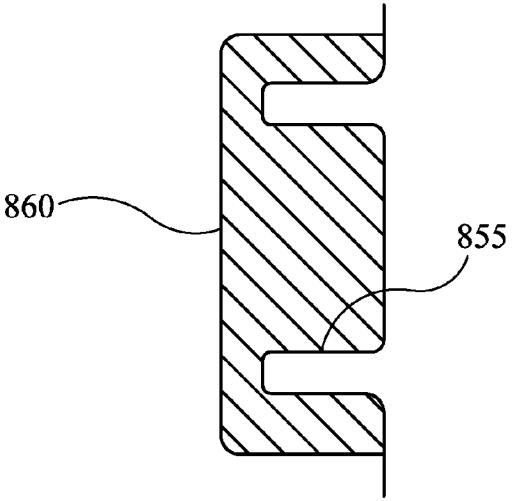
FIG. 8D depicts a top view of an exemplary slide flange with a shelf.

FIG. 8D depicts a top view of an exemplary slide flange with a shelf. A slide channel 855 is configured to receive a slide flange (not shown). The slide channel 855, as depicted, is a U-shaped channel having parallel inner side walls to define an area to receive a corresponding slide flange. A shelf 860, depicted by the angled hash lines, is located at a bottom end of the slide channel 855. The shelf 860 may be configured to support a slide flange that engages the slide channel 855. In some embodiments, the shelf 860 may be attached directly to the slide channel 855. In other embodiments, the shelf 860 may be entirely within the slide channel 855. In another embodiment, the shelf 860 may be support only a portion of an engaging slide flange.

Although various embodiments have been described with reference to the Figures, other embodiments are possible. For example, the CRGEM 600 may be a battery-powered motor unit such as described, for example, at [0051-0060] and in FIGS. 1-9A of U.S. patent application Ser. No. 13/895,787, titled "Battery-Powered Motor Unit," filed by Domholt et al., on May 16, 2013.

In some embodiments, the CMA 200 may include an indicator for a quick indication that the slide flanges 215*a*-215*b*, 220*a*-220*b* are properly inserted into the slide channels 205, 210. The indicators may be located on the CMA 200 or the slide flanges 215*a*-215*b*, 220*a*-220*b*. The indicator may be may be a mechanical turn switch that rotates when the slide flanges 215*a*-215*b*, 220*a*-220*b* are inserted into the slide channels.

In another embodiment, the indicator may be a light source, such as, for example, an LED. The CMA 200 may include sensors, such as, for example, proximity sensors. The sensors may detect insertion of the slide flanges 215*a*-215*b*, 220*a*-220*b* to the slide channels 205, 210 and transmit instruction commands to the light source to flash a particular pattern or color. In some embodiments, the indicator may be an audio speaker to provide an audio alert when the slide flanges 215*a*-215*b*, 220*a*-220*b* are improperly inserted.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A toollessly interchangeable ring gear drive mount system for a rotatable turret, the toollessly interchangeable ring gear drive system comprising:

a ring gear;

a ring gear drive module;

a mount bracket extending in a plane perpendicular to an axis of rotation of the ring gear, the mount bracket being adapted for mounting to a platform arranged in a rotatable relationship to the ring gear;

a pair of receiver members extending from the mount bracket and defining a pair of slide channels, each of the slide channels being defined by a pair of opposing channel sidewalls that are connected by a channel backwall, wherein the slide channels are positioned substantially vertically and oriented substantially parallel to the axis of rotation; and, a pair of mount flanges each sized and shaped to be slidably inserted into a corresponding one of the pair of slide channels, wherein when engaged in the slide channels, the mount flanges are adapted to support the ring gear drive module, wherein the ring gear drive module is configured to permit relative rotation between the mount bracket and the ring gear about the axis of rotation in response to the ring gear drive module being supported by the pair of mount flanges.

2. The toollessly interchangeable ring gear drive mount system of claim 1, wherein the ring gear drive module is adapted to releasably engage a drive gear to the ring gear in response to the pair of mount flanges being slideably inserted into the pair of slide channels, and to disengage the drive gear from the ring gear in response to the pair of mount flanges being slidably removed from the pair of slide channels.

3. The toollessly interchangeable ring gear drive mount system of claim 1, wherein a distance between the channel backwalls of the slide channels varies along an axis parallel to the axis of rotation.

4. The toollessly interchangeable ring gear drive mount system of claim 3, wherein the distance between the channel backwalls of the slide channels varies monotonically along the axis parallel to the axis of rotation.

5. The toollessly interchangeable ring gear drive mount system of claim 1, further comprising a securing pin to releasably secure at least one of the mount flanges to at least one of the receiver members when the securing pin is inserted through an aligned series of apertures in the at least one of the mount flanges and the opposing channel sidewalls of the at least one of the receiver members.

6. The toollessly interchangeable ring gear drive mount system of claim 1, wherein the mount bracket is formed with a curvature that corresponds to a curvature of the ring gear.

7. A toollessly interchangeable ring gear drive mount system for a rotatable turret, the toollessly interchangeable ring gear drive mount system comprising:

a ring gear;

a ring gear drive module;

a mount bracket extending in a plane perpendicular to an axis of rotation of the ring gear, the mount bracket being adapted for mounting to a platform arranged in a rotatable relationship to the ring gear;

a pair of receiver members extending from the mount bracket and defining a pair of slide channels, each of the slide channels being defined by a pair of opposing channel sidewalls that are connected by a channel backwall, wherein the slide channels are positioned substantially vertically and oriented substantially parallel to the axis of rotation; and, a pair of mount flanges each sized and shaped to be slidably inserted into a corresponding one of the pair of slide channels, wherein when engaged in the slide channels, the mount flanges are adapted to support the ring gear drive module, wherein the ring gear drive module is configured to permit relative rotation between the mount bracket and the ring gear about the axis of rotation in response to the ring gear drive module being supported by the pair of mount flanges, and wherein when the pair of mount flanges are slidably inserted into the pair of slide channels, the ring gear drive module is adapted to releasably engage the ring gear via a drive gear of the ring gear drive module.

8. The toollessly interchangeable ring gear drive mount system of claim 7, wherein a distance between the channel backwalls of the slide channels varies along an axis parallel to the axis of rotation.

9. The toollessly interchangeable ring gear drive mount system of claim 8, wherein the distance between the channel backwalls of the slide channels varies monotonically along the axis parallel to the axis of rotation.

10. The toollessly interchangeable ring gear drive mount system of claim 7, further comprising a securing pin to releasably secure at least one of the mount flanges to at least one of the receiver members when the securing pin is inserted through an aligned series of apertures in the at least one of the mount flanges and the opposing channel sidewalls of the at least one of the receiver members.

11. The toollessly interchangeable ring gear drive mount system of claim 7, wherein the mount bracket is adapted to mount to the rotatable turret arranged in a rotatable relationship to the ring gear.

12. The toollessly interchangeable ring gear drive mount system of claim 7, wherein the mount bracket is adapted to mount to a vehicle frame arranged in a rotatable relationship to the ring gear.

13. The toollessly interchangeable ring gear drive mount system of claim 7, wherein the mount bracket is formed with a curvature that corresponds to a curvature of the ring gear.

* * * * *